US008081903B2

(12) United States Patent
Hasegawa

(10) Patent No.: US 8,081,903 B2
(45) Date of Patent: Dec. 20, 2011

(54) FIXING DEVICE, GLOSS PROVIDING DEVICE AND IMAGE FORMING SYSTEM

(75) Inventor: Tohru Hasegawa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 327 days.

(21) Appl. No.: 12/368,710

(22) Filed: Feb. 10, 2009

(65) Prior Publication Data

US 2010/0074662 A1 Mar. 25, 2010

(30) Foreign Application Priority Data

Sep. 24, 2008 (JP) ..... P2008-244027

(51) Int. Cl.
*G03G 15/20* (2006.01)

(52) U.S. Cl. ..... 399/122; 399/107; 399/110; 399/320; 399/328; 399/341; 219/216

(58) Field of Classification Search ..... 399/107, 399/110, 122, 320, 328, 341, 330, 331, 333; 219/216

See application file for complete search history.

(56) References Cited

U.S. PATENT DOCUMENTS

| | | | | |
|---|---|---|---|---|
| 5,250,998 | A * | 10/1993 | Ueda et al. | 399/329 |
| 5,557,388 | A * | 9/1996 | Creutzmann et al. | 399/92 |
| 5,893,666 | A | 4/1999 | Aslam et al. | 399/329 |
| 6,615,018 | B2 * | 9/2003 | Funato | 399/322 |
| 2005/0156377 | A1 | 7/2005 | Jacobs | 271/309 |
| 2006/0140662 | A1 | 6/2006 | Nagase | 399/92 |
| 2007/0059021 | A1 * | 3/2007 | Hanashi et al. | 399/92 |
| 2007/0217841 | A1 | 9/2007 | Fujii | 399/341 |
| 2008/0166161 | A1 | 7/2008 | Washino et al. | 399/329 |
| 2009/0103959 | A1 * | 4/2009 | Koyama et al. | 399/341 |

FOREIGN PATENT DOCUMENTS

| | | | |
|---|---|---|---|
| EP | 0 503 358 | A2 | 9/1992 |
| JP | 60-247672 | | 12/1985 |
| JP | 02-027368 | | 1/1990 |
| JP | 04-180076 | | 6/1992 |
| JP | 04-340577 | | 11/1992 |
| JP | 2006-267426 | A | 10/2006 |
| JP | 2007-225846 | A | 9/2007 |
| JP | 2007-233228 | A | 9/2007 |
| JP | 2008-170541 | A | 7/2008 |

* cited by examiner

*Primary Examiner* — David Porta
*Assistant Examiner* — Jessica L Eley
(74) *Attorney, Agent, or Firm* — Morgan, Lewis & Bockius LLP

(57) ABSTRACT

A fixing device includes a fixing member that comes into contact with a recording medium while rotating a heating unit that heats the fixing member, a pressing member that presses the recording medium to the fixing member while rotating, and an air supply unit that supplies air to a part included in an angle range of 90 degrees toward a downstream side of the pressing member in a rotating direction from a contact position between the pressing member and the fixing member.

11 Claims, 4 Drawing Sheets

FIXING DEVICE, GLOSS PROVIDING DEVICE AND IMAGE FORMING SYSTEM

CROSS-REFERENCE TO RELATED APPLICATION

This application is based on and claims priority under 35 USC 119 form Japanese Patent Application No. 2008-244027 filed Sep. 24, 2008.

BACKGROUND

Technical Field

The present invention relates to a fixing device, a gloss providing device and an image forming system.

SUMMARY

According to an aspect of the invention, a fixing device includes a fixing member that comes into contact with a recording medium while rotating, a heating unit that heats the fixing member, a pressing member that presses the recording medium to the fixing member while rotating, and an air supply unit that supplies air to a part included in an angle range of 90 degrees toward a downstream side of the pressing member in a rotating direction from a contact position between the pressing member and the fixing member.

According to the aspect of the invention, in fixing an image on both surfaces of a recording medium, the change of glossiness of the image that is already fixed is more suppressed than a case in which the present invention defined in claim 1 is not employed.

BRIEF DESCRIPTION OF THE DRAWINGS

Exemplary embodiments of the invention will be described in detail based on the following figures, wherein.

DETAILED DESCRIPTION

(1) First Exemplary Embodiment (Configuration of Gloss Providing Device)

(Summary of Configuration)

Figure 1:
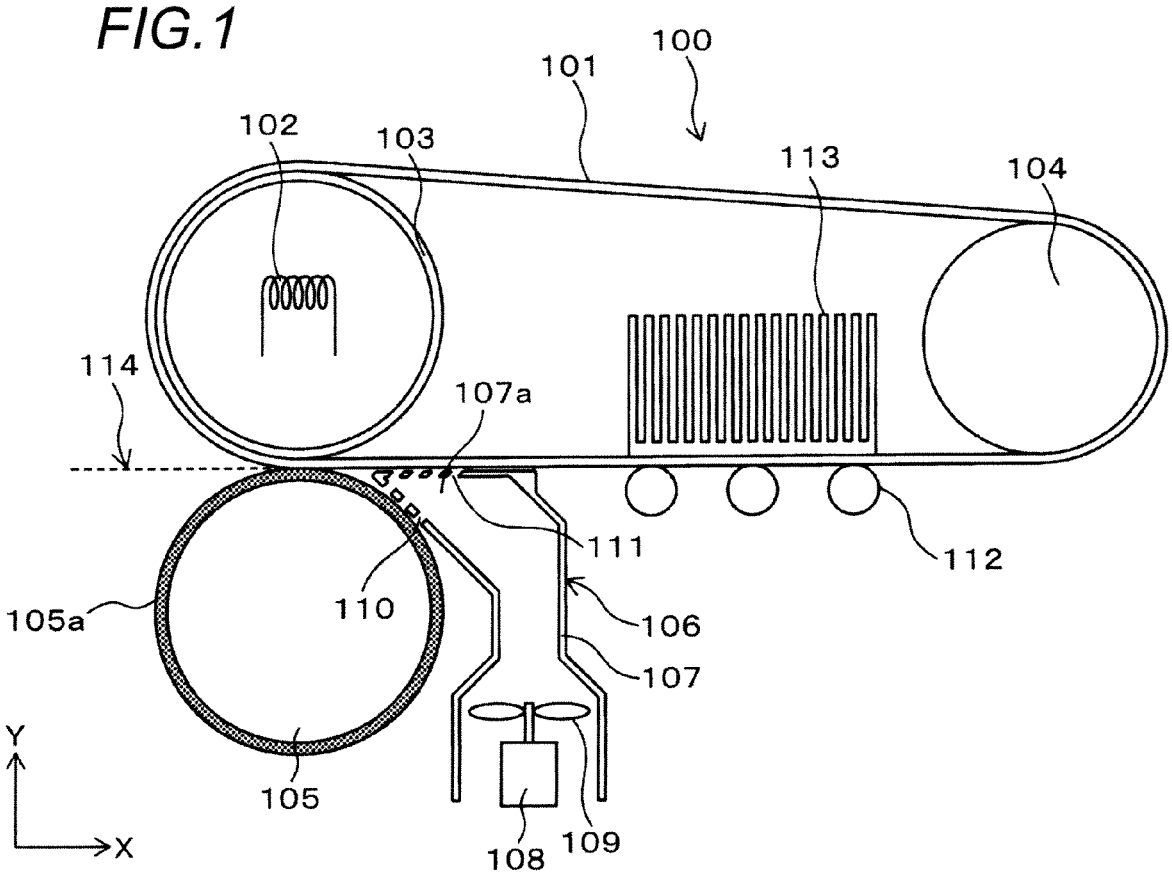
FIG. 1 is a conceptual view showing one example of a gloss providing device.

Now, one example employing the present invention will be described below. FIG. 1 is a conceptual view showing one example of a gloss providing device employing the present invention. In FIG. 1, a gloss providing device 100 is shown. In this exemplary embodiment, a belt 101 is used as a closing belt shaped member rotating under a state that the belt shaped member comes into contact with a recording medium. Further, in this exemplary embodiment, as a heating unit for heating a back surface side of a part of the belt shaped member in contact with the recording medium, a heat roll 103 is used. Further, in this exemplary embodiment, as a member rotating for pressing the recording medium to the heating unit, a pressing roll 105 is used. Further, in this exemplary embodiment, as an air supply unit for supplying air to a part included in an angle range of 90 degrees to a downstream side in the rotating direction from a part of the rotating member that presses the recording medium, an air supply device 106 is used.

The air supply device 106 also supplies air to a part in a downstream side of the part of the recording medium in contact with the pressing roll 105. The air supply device 106 is provided with a duct 107. The duct 107 includes an air supply path 107*a* as one example of a part extending to a part in which the belt shaped member is opposed to the rotating member. The air supply path 107*a* is extended toward a part in which the belt 101 is opposed to the pressing roll 105, in other words, a part where a distance between the belt 101 and the pressing roll 105 is minimum. Then, the air supply path 107*a* includes an air supply port 111 as one example of an air supply unit for supplying air to a side facing the belt 101 and an air supply port 110 as one example of an air supply unit for supplying air to a side facing the pressing roll 105.

The gloss providing device 100 further includes a heat sink 113 as one example of a cooling unit for cooling the recording medium. The air supply device 106 supplies air to the recording medium in the upstream side of the heat sink 113. An air supply direction includes a component corresponding to the transporting direction of the recording medium.

The gloss providing device 100 has a function for providing the gloss to an image formed on the recording medium by heating and pressing the surface of the recording medium to provide such smoothness (few irregularities) as to produce the sense of gloss on the surface of the recording medium.

(Detail of Configuration)

In this example, as the recording medium, an ordinary cast coated sheet (for instance, Mirror Coat Platinum produced by Oji Paper Co., Ltd.) is used. In the following explanation, the recording medium is referred to as a recording sheet. The gloss providing device 100 includes the belt 101 formed with a closing belt shaped rubber member rotating in contact with the recording sheet. The surface of the belt 101 facing the recording sheet is designed in such a way that the smoothness (few irregularities) of the surface may provide a required gloss level to the recording medium. As such a surface, for instance, a mirror surface may be exemplified whose 20-degree specular gloss prescribed by JISZ8741 is defined as 80 or more.

The belt 101 is extended between the heat roll 103 in which a heater 102 is incorporated and a driving roll 104. Both the heat roll 103 and the driving roll 104 have cylindrical forms. The driving roll 104 rotates counterclockwise in the drawing by a motor whose illustration is omitted and the belt 101 is rotated counterclockwise by this rotation. At this time, the heat roll 103 receives a driving force from the belt 101 to rotate counterclockwise in the drawing. The driving roll 104 also functions as one example of a separating member. That is, the driving roll 104 has a function for separating the recording sheet transported in tight contact with the belt 101 from the belt 101.

The pressing roll 105 is arranged so as to be opposed to the heat roll 103. The pressing roll 105 has a cylindrical form whose surface is coated with a rubber layer 105*a*. The pressing roll 105 holds the belt 101 between the heat roll 103 and the pressing roll 105 to apply pressure to the belt 101.

A broken line shown by reference numeral 114 designates a transporting path on which the recording sheet is transported. The recording sheet is transported to a positive direction of an X axis in the drawing. The recording sheet transported in the transporting path 114 is sandwiched between the pressing roll 105 and the belt 101 and a surface that comes into contact with the belt 101 is heated by the heat roll 103 and receives a pressure from the pressing roll 105 and is pressed to the belt 101.

Figure 2A:
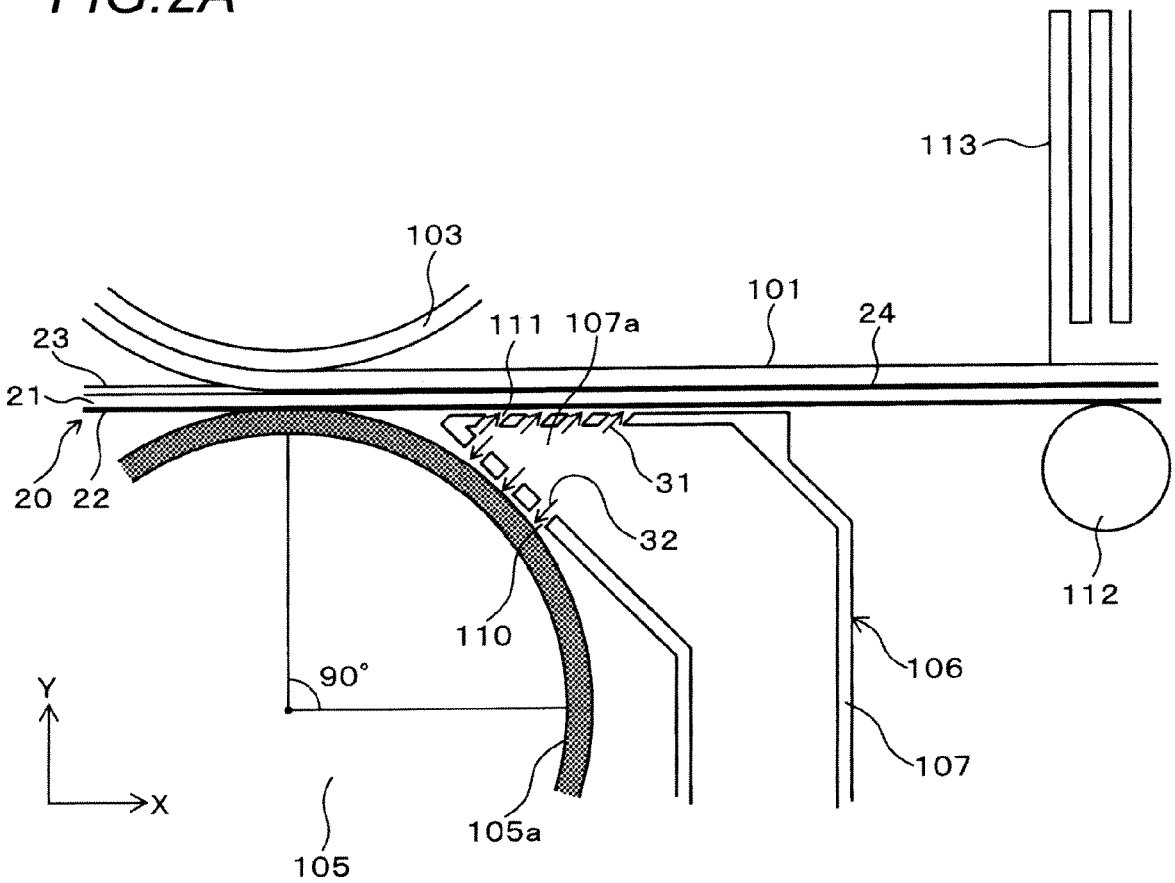
FIG. 2A is an enlarged view in which a part of FIG. 1 is enlarged.
Figure 2B:
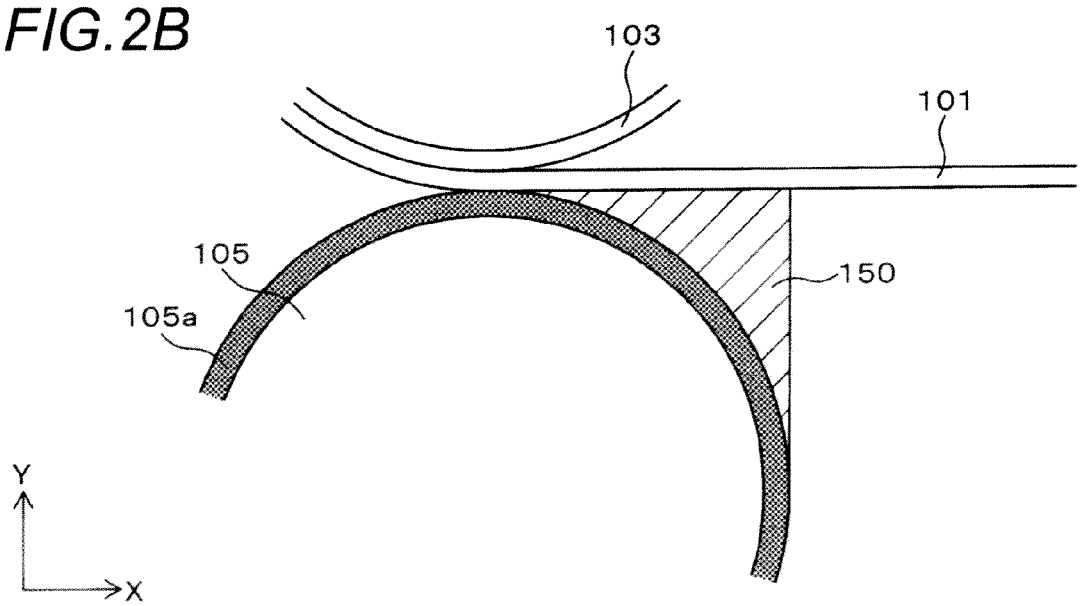
FIG. 2B is an enlarged view showing a wedge shaped space in FIG. 2A.

FIG. 2A is an enlarged view in which a part of FIG. 1 is enlarged. FIG. 2B is an enlarged view for explaining a wedge shaped space in the exemplary embodiment. In FIG. 2A, the recording sheet 20 whose illustration is omitted in FIG. 1 is shown. In the recording sheet 20 shown in FIG. 2A, images to which a fixing process is applied are formed on both surfaces of a base material 21. Reference numeral 22 designates a layer for constructing an image formed on a surface of the recording sheet 20 in a negative direction side of a Y axis. In the layer 22, a process for fixing toner and a process for providing gloss are carried out. Reference numeral 23 designates a layer for constructing an image formed on a surface of the recording sheet 20 in a positive direction side of the Y axis. In the layer 23, a process for fixing toner is carried out, however, a process for providing the gloss is not carried out. Then, a state in which the process for providing the gloss to the layer 23 is being carried out is shown as a layer 24.

In a downstream side in the transporting direction (the positive direction side of the X axis) of a part in which the recording sheet 20 is sandwiched between the belt 101 and the pressing roll 105 the air supply device 106 is arranged. The air supply device 106 is provided with the duct 107. In the duct 107, a fan 109 driven by a motor 108 is arranged. The duct 107 is arranged in the wedge shaped space arranged in the upstream side from the most downstream part in the transporting direction of the recording medium of the pressing roll 105 and formed by the outer peripheral surface of the pressing roll 105 and the belt 101. FIG. 2B shows the wedge shaped space 150 in this example. In FIG. 2B, the description and illustration of the duct 107 are omitted. In this example, the wedge shaped space 150 has a top part provided in a part where the pressing roll 105 is opposed to the heat roll 103.

Viewing from an illustrated visual point (a direction vertical to an X-Y plane in the drawing), a downstream side in the air supply direction of the duct 107 is set to the air supply path 107*a* extended toward the part (the top part of the wedge shaped space) where the belt 101 and the pressing roll 105 are opposed to each other. The air supply path 107*a* has a tapered shape in section that enters a space (the wedge shaped space) between the belt 101 and the pressing roll 105 and the air supply ports 110 and 111 are provided in the wedge shaped space. More specifically, the air supply port 110 is provided in a surface of the duct 107 having the tapered shape in section that is opposed to the pressing roll 105 and the air supply port 111 is provided in a surface opposed to the belt 101. Air supplied from the fan 109 flows in the duct 107 and a part of the air is supplied to the direction (a direction shown by an arrow mark 32) of the pressing roll 105 from the air supply port 110 and a flow of remaining air is supplied to the direction (a direction shown by an arrow mark 31) of the belt 101 from the air supply port 111.

The wedge shaped space 150 in this exemplary embodiment has a form including a circular arc of about (150Π/4) mm and two sides of about 75 mm. In this case, the duct 107 may be located in the wedge shaped space 150 and designed so that the duct 107 does not come into contact with the belt 101 and the pressing roll 105.

As shown in FIG. 2A, the air supply port 110 is directed to supply air to a part of an angle range of 90 degrees toward a downstream side in the rotating direction from a contact position of the pressing roll 105 with the recording sheet 20. The air supply port 111 supplies an air flow to directions having components in a direction vertical to the surface of the recording sheet 20 (a positive direction of a Y axis in the drawing) and the transporting direction of the recording sheet 20 (the positive direction of the X axis in the drawing). The direction of the air supply port 111 does not have a component in a negative direction of the X axis. Further, the component in the positive direction of the Y axis of this air flow produces a force for pressing the recording sheet 20 to the belt 101. When a certain part of a rotating member is noticed, the downstream side in the rotating direction means a forward side to which the certain part moves afterward due to the rotation thereof.

In the downstream side of the air supply device 106 seen in the transporting direction (the positive direction of the X axis) of the recording sheet, three push rolls 112 are arranged that push the transported recording sheet 20 to the belt 101 from a negative direction side of the Y axis. The push rolls 112 freely rotate and are pushed to the belt 101 by a spring whose illustration is omitted. According to this configuration, the push rolls 112 generate a pressure for pressing the transported recording sheet to the belt 101.

With a surface of the belt 101 opposite to a side in which the push rolls 112 are arranged, the heat sink 113 comes into contact. The heat sink 113 is a heat radiator made of a metal material such as aluminum or copper and includes plural fins for improving a heat radiation property. The heat sink 113 is provided with an air supply fan, which is not shown in the drawing, for supplying air to cool the heat sink 113.

(Operation of Gloss Providing Device)

Now, one example of an operation of the gloss providing device 100 will be described below. Here, a case will be described that on the surface of the recording sheet which comes into contact with the belt 101, an image is formed to which the fixing process is applied, however, the process for providing gloss is not carried out, and on the surface of the recording sheet which comes into contact with the pressing roll 105, and an image is formed to which the fixing process and the gloss providing process are carried out.

When an operation is started, the heater 102 generates heat and the driving roll 104 rotates counterclockwise in the drawing. The belt 101 rotates counterclockwise due to this rotation. Further, the fan 109 rotates and the air is supplied from the air supply ports 110 and 111. Under this state, the recording sheet in the above-described state is transported on the transporting path 114 to the positive direction of the X axis in the drawing and sandwiched between the belt 101 and the pressing roll 105. At this time, the pressing roll 105 rotates clockwise by a frictional force in accordance with the movement of the belt 101.

When the recording sheet comes into contact with the belt 101, as shown in FIG. 2A, the layer 23 is sandwiched between the belt 101 and the pressing roll 105 to be pressed, and heated from the heat roll 103 at that time. After that, the layer 23 (namely, the recording sheet 20) moves in the positive direction of the X axis in FIG. 2A under a state that the layer 23 comes into close contact with the belt 101. In the drawing, a state is shown in which the layer 23 is sandwiched between the belt 101 and the pressing roll 105 and pressed so that the layer 24 is changed. In this process, the surface of the layer 24 in close contact with the belt 101 is softened or molten, so that the surface state of the belt 101 is transferred to the layer 24. The surface state of the belt 101 is transferred to the layer 24 to provide the gloss to the surface of the layer 24. During a process that the layer 24 is transported to the heat sink 113 under a state that the layer comes into close contact with the belt 101, the temperature of the layer 23 is higher than that under a state that the layer 23 is sandwiched between the belt 101 and the pressing roll 105 due to heat transmitted from the belt 101.

The direction of the air supply port 111 includes a component corresponding to the positive direction of the X axis as the transporting direction of the recording sheet 20. Accordingly, the air flow from the air supply port 111 does not have a component opposed to a front edge part of the recording sheet 20 moving to the positive direction of the X axis. Therefore, a phenomenon is more suppressed that the front edge of the recording sheet 20 floats from the belt 101 by the air flow than a case that the direction of the air supply port 111 does not have the component in the positive direction of the X axis. Further, the air flow supplied from the air supply port 111 generates a force for pressing the recording sheet 20 to the belt 101. Therefore, an adhesion of the recording sheet 20 to the belt 101 becomes higher than a case that a pressing force by the air flow does not function. The adhesion becomes higher so that the gloss is more effectively provided to the surface of the layer 24 than a case that the pressing force due to the air flow does not arise.

After that, the recording sheet reaches a lower surface of the heat sink 113 and the heat of the layer 24 is taken by the heat sink 113 to lower the temperature of the layer 24. As a result, the above-described transferred state is fixed. The recording sheet passing through the part of the heat sink 113 is separated from the belt 101 at the part of the driving roll 104, further moved rightward in the drawing and discharged from the gloss providing device 100.

(Operation for Suppressing Deterioration of Gloss)

Under a state that the pressing roll 105 is rotating clockwise in the drawing the pressing roll 105 is heated at a part where the pressing roll 105 comes into contact with the belt 101 or the recording sheet 20. The temperature of a part of the surface (the rubber layer 105*a*) of the heated pressing roll 105 rises. Then, the part whose temperature rises is cooled by the air flow supplied the air supply port 110 in the angle range of 90 degrees toward the downstream side in the rotating direction from the part where the pressing roll 105 comes into contact with the belt 101 or the recording sheet 20.

In the movement of a quantity of heat from a high temperature object to a low temperature object, as the temperature difference between both the objects is larger, a heat flux density is the higher. That is, in the movement of the quantity of heat from the high temperature object to the low temperature object, as the temperature difference between both the object is larger, the quantity of heat that moves for a unit time is the more increased. Accordingly, a cooling operation by supplying the air flow in the angle range of 90 degrees toward the downstream side in the rotating direction from a position where the pressing roll 105 comes into contact with the belt 101 or the recording sheet 20 is higher in its cooling efficiency than a cooling operation by similarly supplying the air flow in other angle range than the above-described angle range. Further, since the air supply port is located in the wedge shaped space, the air is supplied from a position closer to the pressing roll 105 than a case that the air supply port is located in another position. Further, since the wedge shaped space is enclosed by the pressing roll 105 and the belt 101, cooled air is supposed to more readily stay immediately after a nip part and a cooling effect thereby is also supposed to be exhibited.

A downstream side of a part of the layer 22 that comes into contact with the pressing roll 105 is cooled by the air flow supplied from the air supply port 111. The air flow is supplied to the layer 22 in an upstream side of a part where the layer 24 is cooled by the heat sink 113. Since the quantity of heat moves to the recording sheet from the belt 101 with a time difference, the temperature of the layer 22 reaches a maximum temperature after the layer 22 comes into contact with the pressing roll 105 and before the layer 22 reaches a position of the heat sink 113 in the range shown in FIG. 2A. Accordingly, the air flow is supplied to the layer 22 in the downstream side from the part where the layer 22 comes into contact with the pressing roll 105 and in the upstream side of the heat sink 113. This operation is more effectively suppress the rise of the temperature of the layer 22 than a case that the air flow is supplied to the layer 22 at the position of the heat sink 113 or in the downstream side of the heat sink 113.

In providing the gloss to the layer 23, when the temperature of the layer 22 rises to soften or melt solidified toner forming the layer 22, the sense of gloss of the layer 22 is deteriorated. Accordingly, when the upper limit of the temperature of the layer 22 is set to temperature at which the toner is not softened nor molten, which is a factor of deteriorating the sense of gloss, the deterioration of the sense of gloss of the layer 22 may be suppressed.

Now, an actual example will be described below. In this example, outlines of the heat roll 103 and the pressing roll 105 have 150 mm, the width of these rolls (axial length) is 400 mm. Further, the thickness of the rubber layer 105*a* is 3 mm. Here, it is assumed that the moving speed of the belt 101 is 150 mm/sec, the temperature of generated heat of the heat roll 103 is 150 degrees Celsius, a central angle position (an angle from a position opposed to the heat roll 103) of the air supply port 111 in the pressing roll 105 is 75 degrees, a total area of the air supply port 110 is about 9000 mm2 and a total area of the air supply port 111 is about 11000 $mm^2$. In this case, when an experiment is carried out for the purpose of obtaining a result that the temperature of a part of the pressing roll 105 which comes into contact with the heat roll 103 (a part of the rubber layer 105*a* opposed to the heat roll 103) is about 70 degrees Celsius and the temperature of the recording sheet in the belt 101 side at the time of passing through the heat sink 113 is about 60 degrees Celsius, it is recognized that the fan 109 having a maximum air volume of 5 m3/min may be used.

(2) Second Exemplary Embodiment (Configuration)

Figure 3:
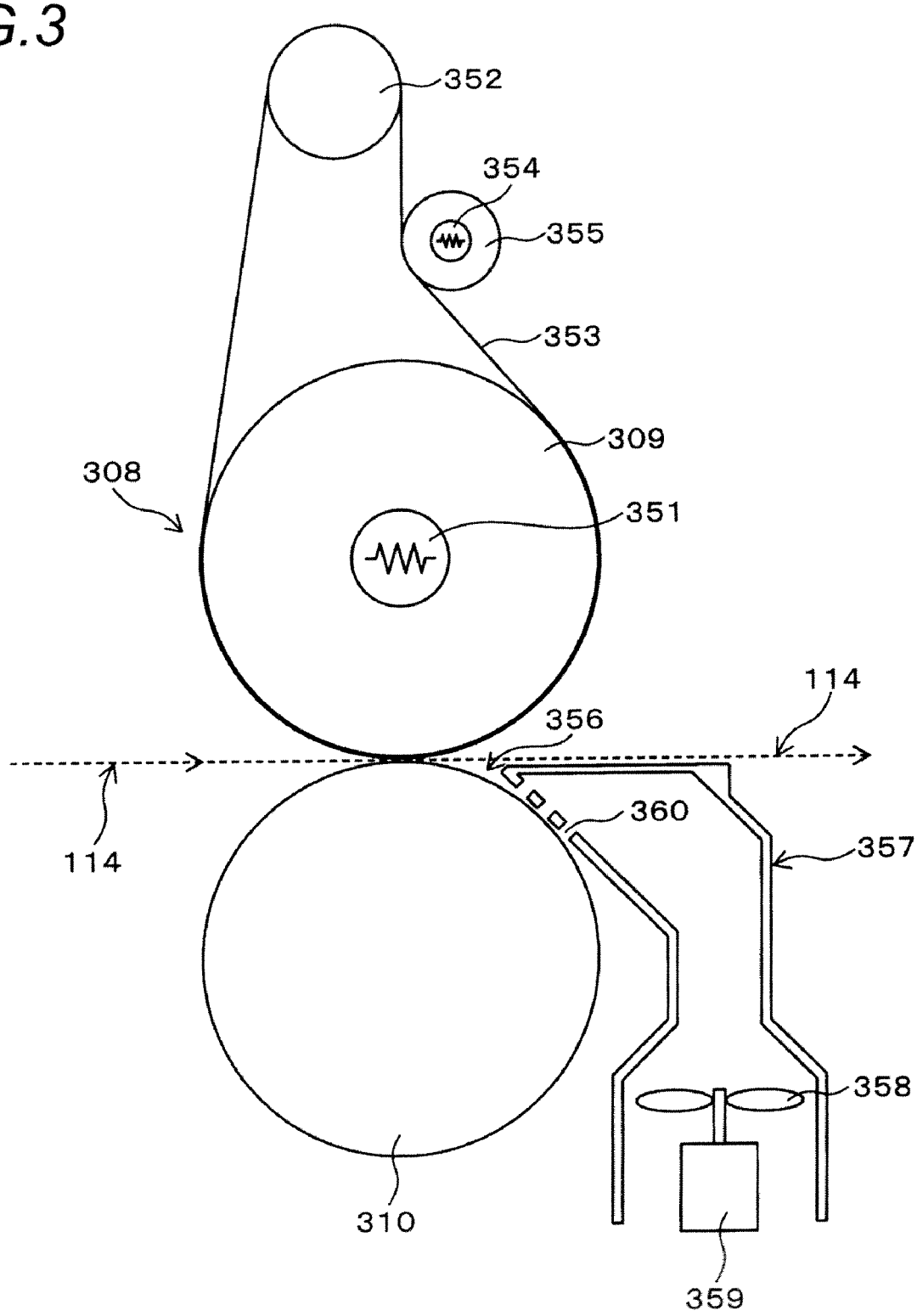
FIG. 3 is a conceptual view showing one example of a fixing device.

FIG. 3 is a conceptual view showing one example of a fixing device. Inn FIG. 3, a fixing device 308 is shown that applies heat and pressure to a toner image on a recording sheet to fix the toner image to the recording sheet. The fixing device 308 includes a fixing roll 309 and a pressing roll 310.

The fixing roll 309 is provided with a heater 351. Further, the fixing roll 309 is rotated by a driving mechanism not shown in the drawing. A fixing belt 353 is extended between the fixing roll 309 and a tension roll 352. The tension roll 352 applies a tensile force to the fixing belt 353. A heating roll 355 in which a heater 354 is incorporated comes into contact with the fixing belt 353.

The pressing roll 310 is arranged so as to be opposed to the fixing roll 309. A transporting path 114 of the recording sheet is provided between the fixing roll 309 and the pressing roll 310 and the recording sheet is transported on the transporting path 114 from a left side to a right side in the drawing. In a wedge shaped space 356 between the pressing roll 310 and the transporting path 114 in the downstream side from a part of the pressing roll 310 opposed to the fixing roll 309, an air supply device 357 is arranged. The air supply device 357 includes a fan 358, a motor 359 for driving the fan 358 and an air supply port 360. The air supply port 360 is arranged in the wedge shaped space 356 to supply air generated by the fan 358 to a rotating range of 90 degrees of the pressing roll 310 in the downstream side from the part where the pressing roll 310 is opposed to the fixing roll 309.

(Operation)

Initially, as a preliminary operation, the heaters 351 and 354 are allowed to generate heat and the fixing roll 309 is rotated counterclockwise in the drawing. Under this state, the fixing belt 353 is heated and rotated counterclockwise in the drawing. Further, in this stage, the fan 358 is rotated to start the supply of air from the air supply port 360.

After the toner image is formed on the recording sheet in an image forming part whose illustration is omitted in FIG. 3, the recording sheet is transported on the transporting path 114 from the left side to the right side in FIG. 3. When the recording sheet transported on the transporting path 114 reaches a part of the fixing device 308, the recording sheet is sandwiched between the fixing belt 353 and the pressing roll 310 in the part where the fixing roll 309 and the pressing roll 310 are opposed to each other. At this time, the pressure and heat are applied to the recording sheet to fuse toner that is not fixed yet and fix the toner image formed on the recording sheet to the recording sheet as an image.

At this time, the pressing roll 310 is heated in the part where the pressing roll 310 is opposed to the fixing roll 309 and the heated part is sequentially rotated clockwise in the drawing. The heated part passes a part opposed to the air supply port 360 and is cooled by an air flow supplied from the air supply port 360 at that time.

A cooling operation of the pressing roll 310 by supplying air from the air supply port 360 is carried out with high efficiency because of the same reasons described in the example shown in FIGS. 1 and 2. Then, an excessive heat to the recording sheet from the pressing roll 310 is suppressed.

When images are formed on both the surfaces of the recording sheet, after the image is formed and fixed on the first surface, an image is formed and fixed on the second surface. When the image is fixed on the second surface, the first surface on which the image is already fixed comes into contact with the pressing roll 310. When the pressing roll 310 is insufficiently cooled, the temperature of the first surface rises, so that the toner of the fixed image may be possibly molten or softened again to change the sense of gloss. The pressing roll 310 is cooled by supplying the air from the above-described air supply port 360 so that the change of the sense of gloss may be suppressed.

(3) Third Exemplary Embodiment (Image Forming System)

Figure 4:
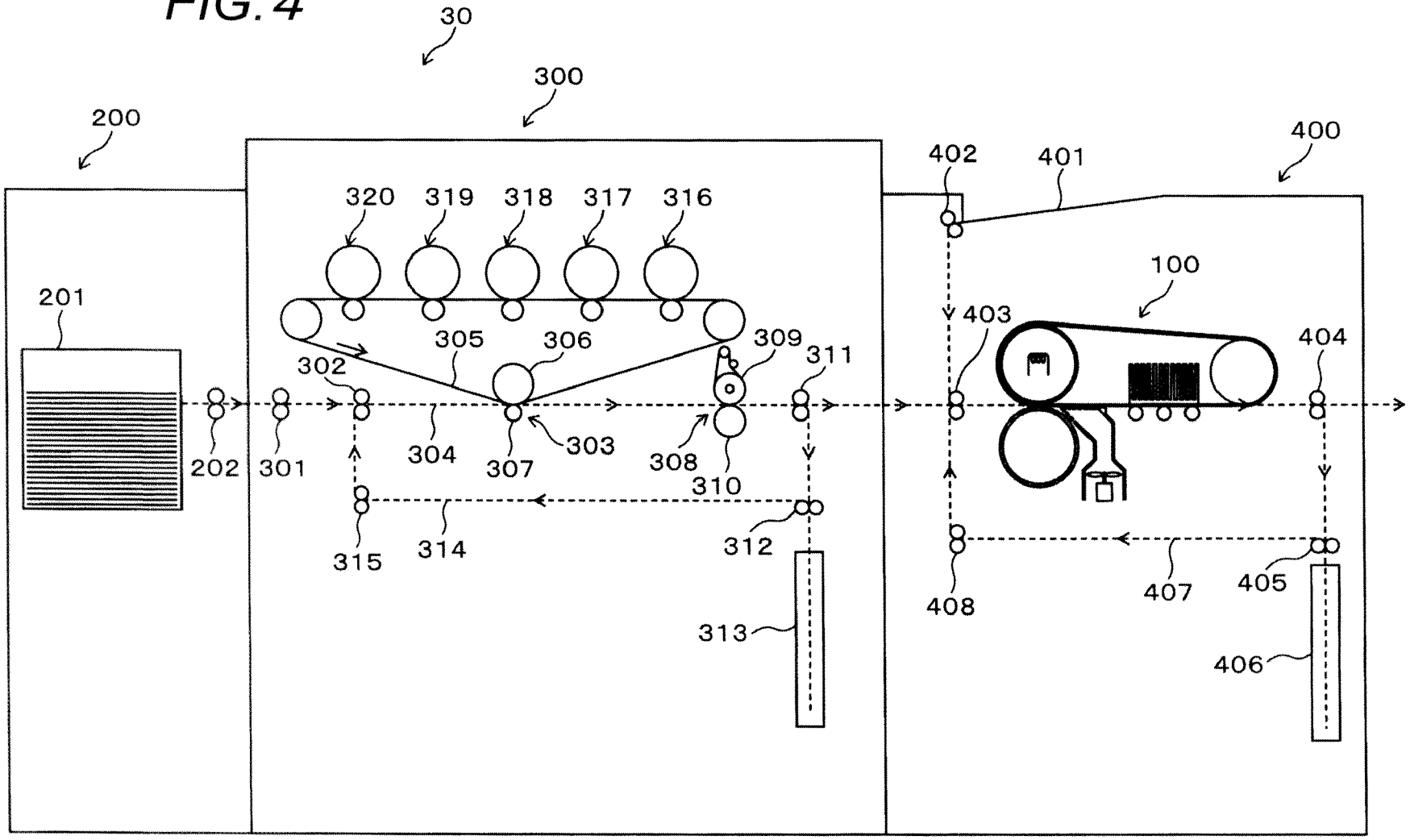
FIG. 4 is a conceptual view showing one example of an image forming system.

Now an example of an image forming system will be described that includes the gloss providing device described in the first exemplary embodiment and the fixing device described in the second exemplary embodiment. FIG. 4 is a conceptual view showing one example of the image forming system employing the present invention. FIG. 4 shows the image forming system 30 including a recording sheet supply unit 200 for supplying a recording medium, an image forming unit 300 as one example of an image forming member for forming images on both surfaces of the recording medium, a fixing device 308 arranged in the image forming unit, and a gloss providing unit 400 located in the downstream side of the image forming unit 300 as one example of a gloss providing member for providing gloss to both the surfaces of the recording medium.

(Recording Sheet Supply Unit)

The recording sheet supply unit 200 includes an accommodating device 201 for accommodating plural recording sheets, a delivery mechanism, whose illustration is omitted, for delivering the recording sheets rightward from the accommodating device 201 and a transporting roll 202 for transporting the recording sheets delivered from the delivery mechanism rightward in the drawing.

(Image Forming Unit)

The image forming unit 300 includes a transporting roll 301 for taking in the recording sheets delivered from the recording sheet supply unit 200 to the image forming unit 300. In the downstream side of the transporting roll 301, a transporting roll 302 is arranged that transports the recording sheets supplied from the transporting roll 301 or the recording sheets supplied from a below-described transporting roll 315 to a secondary transfer part 303 on a transporting path 304. The secondary transfer part 303 includes a transfer roll 306 and an opposed roll 307 to sandwich a transfer belt 305 and the recording sheet between them so that a toner image on the transfer belt 305 is transferred to the recording sheet.

In the downstream side of the secondary transfer part 303, the fixing device 308 is arranged. The fixing device 308 has a configuration and functions described in connection with FIG. 3.

In the downstream side of the fixing device 308, a transporting roll 311 is arranged. The transporting roll 311 sends the recording sheet delivered from the fixing device 308 to the gloss providing unit 400 or toward a transporting roll 312. The transporting roll 312 sends the recording sheet supplied from the transporting roll 311 to a reversing device 313 and sends the recording sheet delivered from the reversing device 313 to a transporting path 314. In the transporting path 314, a transporting roll 315 is arranged that sends the recording sheet transported leftward in the drawing to the transporting roll 302.

The transporting path 314 is a transporting path for reversing the front and back surfaces of the recording sheet. That is, when the images are formed on both the surfaces of the recording sheet, the recording sheet delivered from the accommodating device 201 is initially transported rightward on the transporting path 304 in the drawing and the image is formed on its one side (an upper side surface in the drawing) at the same time. The transporting path of this recording sheet is changed downward in the part of the transporting roll 311 and the recording sheet enters the reversing device 313 via the transporting roll 312. In the reversing device 313, the recording sheet that enters from an upper part of the drawing is returned in a reverse direction (an upper part in the drawing). The recording sheet returned upward is sent to the transporting path 314 from the transporting roll 312. The recording sheet sent to the transporting path 314 is sent to the transporting roll 302 from the transporting roll 315 and returned to the transporting path 304 again. In the recording sheet returned to the transporting path 304, the front and back surfaces are reversed to those during the initial transporting operation of the recording sheet. Thus, a remaining another surface faces the transfer belt 305 side. According to such an arrangement, the image is formed on the back surface side of a first image forming surface.

The image forming unit 300 includes primary transfer units 316, 317, 318, 319 and 320. The primary transfer units respectively include photosensitive drums, cleaning devices, charging devices, exposure devices, developing devices and transfer rolls. The primary transfer unit 316 forms a toner layer of transparent color to transfer the toner layer to the rotating transfer belt 305. The primary transfer units 317, 318, 319 and 320 form toner images of Y (yellow), M (magenta), C (cyan) and K (black) to transfer the toner images to the rotating transfer belt 305. The toner layer of the transparent color is overlapped on the toner images of YMCK to form a colored toner image on the transfer belt 305. Here, the toner layer of the transparent color is softened or molten in a below-described process for providing gloss to have a function for producing the sense of gloss.

(Gloss Providing Unit)

The gloss providing unit 400 includes a gloss providing device 100 shown in FIG. 1, a recording sheet mounting surface 401 and transporting rolls 402 and 403. To the gloss providing device 100, the recording sheet delivered from the image forming unit 300 or the recording sheet mounted on the recording sheet mounting surface 401 is supplied.

In the downstream side of the recording sheet mounting surface 401, the transporting roll 402 is arranged. The transporting roll 402 takes in the recording sheet mounted on the recording sheet mounting surface 401 to the gloss providing unit 400 and sends the recording sheet to the transporting roll 403. The transporting roll 403 has a function for sending the recording sheet delivered from the image forming unit 300 to the gloss providing device 100, a function for sending the recording sheet supplied from the transporting roll 402 to the gloss providing device 100 and a function for sending to the gloss providing device 100 the recording sheet supplied from a below-described transporting path 407 for reversing the front and back surfaces of the recording sheet.

The gloss providing unit 400 includes a front and back reversing unit for reversing the front and back surfaces of the recording medium. The front and back reversing unit includes a reversing device 406. Before the reversing device 406, a transporting roll 405 is arranged. The transporting roll 405 sends the recording sheet to the reversing device 406 and sends out the recording sheet delivered from the reversing device 406 to the transporting path 407.

The front and back reversing unit functions as described below. The recording sheet delivered from the image forming unit 300 is taken in to the gloss providing unit 400 by the transporting roll 403, and a process for providing gloss to one surface thereof is carried out in the gloss providing device 100. The recording sheet having one surface to which the gloss is provided enters the reversing device 406 via the transporting roll 405 from a transporting roll 404. In the reversing device 406, the recording sheet entering from an upper part in the drawing is returned in a reverse direction (the upper part in the drawing). The recording sheet returned upward is sent to the transporting path 407 from the transporting roll 405. Then, the recording sheet enters again the gloss providing device 100 from the transporting roll 403 via a transporting roll 408. At this time, the front and back surfaces of the recording sheet are reversed to those during a first transporting operation of the recording sheet. Then, a process for providing the gloss to a remaining another surface is carried out.

(Example of Operation)

Now, one example of an operation will be described below that is carried out when the image is formed on the recording sheet accommodated in the accommodating device 201, and further, a process for providing the gloss thereto is carried out. Initially, the recording sheet accommodated in the accommodating device 201 is transported rightward in the drawing by the transporting roll 202 and delivered to the image forming unit 300 from the recording sheet supply unit 200. The recording sheet taken in to the image forming unit 300 is transported rightward on the transporting path 304 in the drawing and sent to the secondary transfer part 303.

Synchronously with this timing, the transparent toner layer and the toner images of YMCK are laminated on the transfer belt 305 by the operations of the primary transfer units 316 to 320 to form the colored toner image. The colored toner image on the transfer belt 305 is transferred to the recording sheet in the secondary transfer part 303. The colored toner image transferred to the recording sheet has the transparent toner layer formed on an uppermost layer. The colored toner image on the recording sheet is fixed on the recording sheet in the fixing device 308. In such a way, the image is formed and fixed on the first surface.

The recording sheet on which the image is fixed is sent to the reversing device 313 by the operation of the transporting roll 311. In the reversing device 313, an advancing direction of the recording sheet is reversed and the recording sheet is sent out to the transporting path 314 from the transporting roll 312. The recording sheet transported on the transporting path 314 is sent to the transporting path 304 via the transporting rolls 315 and 302.

In this stage, in the recording sheet on the transporting path 304, a second surface as the back surface side of the above-described first surface faces toward the transfer belt 305. Then, a toner image (and a transparent toner layer) for the second surface is formed on the transfer belt 305 by the operations of the primary transfer units 316 to 320. The toner image is transferred to the second surface of the recording sheet transported on the transporting path 304 in the secondary transfer part 303. The toner image transferred to the second surface is fixed on the recording sheet in the fixing device 308. In such a way, the image is formed and fixed on the second surface. At this time, a fixing roll 310 is cooled by supplying air, so that the change of the sense of gloss of the image formed on the first surface due to the rise of temperature is suppressed.

In accordance with the above-described operations, the images are formed on both the surfaces of the recording sheet. Then, the recording sheet in which the images are formed on both the surfaces is delivered to the gloss providing unit 400 from the transporting roll 311.

The recording sheet taken in to the gloss providing unit 400 is transported to the gloss providing device 100 from the transporting roll 403 to carry out the process for providing the gloss to the second surface. The recording sheet in which the process for providing the gloss to the second surface is carried out is sent to the reversing device 406 from the transporting roll 404, the advancing direction of the recording sheet is reversed in the reversing device 406, and the recording sheet is sent to the transporting path 407 from the transporting roll 405. The recording sheet transported on the transporting path 407 enters the gloss providing device 100 via the transporting rolls 408 and 403.

In this stage, the first surface to which the gloss is not provided faces the belt 101 of the gloss providing device 100 (see FIG. 1). Then, in the gloss providing device 100, the gloss is provided to the first surface. At this time, in accordance with a principle described in connection with FIGS. 1 and 2, an operation is carried out for suppressing the rise of the temperature of the second surface to which the gloss is already provided.

In such a way, the images are formed to both the surfaces of the recording sheet and the process for providing the gloss thereto is carried out. After that, the recording sheet is discharged rightward in the drawing from the transporting roll 404.

(Other Example of Operation)

An explanation will be given to an example of a case that a process for providing gloss to the other surface of the recording sheet in which images are formed on both surfaces and gloss is provided to one surface thereof. In this case, the recording sheet in which the images are formed on both the surfaces and the gloss is provided to the one surface is mounted on the sheet mounting surface 401 of the gloss providing unit 400. At this time, the surface to which the gloss is to be provided is directed downward.

Under this state, when the gloss providing unit 400 is started, the recording sheet on the sheet mounting surface 401 is taken in to the gloss providing unit 400 by the transporting roll 402. The recording sheet taken to the gloss providing unit is sent to the gloss providing device 100 via the transporting roll 403 to provide the gloss to the other surface to which the process for providing the gloss is not carried out in the gloss providing device 100. At this time, in accordance with the principle described in connection with FIGS. 1 and 2, an operation is carried out for suppressing the rise of the temperature of the surface to which the gloss is already provided.

Modified Example)

In FIG. 4, the configuration is exemplified that the toner image formed on the transfer belt is transferred to the recording sheet, however, a configuration may be used that a toner image is directly transferred to a recording sheet from a photosensitive roll without using a transfer belt. Further, when a recording sheet in which a surface of a sheet type paper is coated with a thermoplastic resin is used as a recording medium, the thermoplastic resin layer and the toner image on the recording sheet which are softened and molten come into close contact with a belt so that the toner image is embedded in the thermoplastic resin layer and the sense of gloss is given in accordance with a principle described in connection with FIG. 1.

In FIG. 4, the image forming system 30 is shown in which the recording sheet supply unit 200, the image forming unit 300 and the gloss providing unit 400 are respectively connected together, however, the units may be respectively integrated to have a united configuration as one device.

The gloss providing device 100 shown in FIG. 1 has a principle for providing the sense of gloss to the image formed on the recording sheet by heating and pressing an image forming surface of the recording sheet to provide such smoothness (few irregularities) as to produce the sense of gloss on the image forming surface. An object to which the gloss is provided by employing the principle is not limited to an image formed by an electro-photographic method and may be an image formed by an ink jet system or an offset printing system. When the transparent toner layer is formed on these images, the transparent toner is softened or molten so that the sense of gloss is obtained in accordance with the principle described in connection with FIG. 1.

In the image forming unit, two transfer mechanisms including transfer belts and plurality of primary transfer units may be prepared and connected in series so that an image is formed on a first surface by the transfer mechanism of a pre-stage and an image is formed on a second surface by the transfer mechanism of a post stage.

In the gloss providing unit, two gloss providing devices may be prepared and connected in series so that gloss is provided to a first surface by the gloss providing device of a pre-stage and gloss is provided to a second surface by the gloss providing device of a post-stage. In this case, the gloss providing device of the post-stage uses the configuration shown in FIG. 1.

In the image forming system 30 shown in FIG. 4, when an exclusive recording sheet on which a gloss layer is previously formed is used, a transfer function of the primary transfer unit 316 does not operate. In this case, a toner image of basic colors of YMCK is formed on the recording sheet.

In the example shown in FIG. 1, the heat roll 103 is rotated in accordance with the rotation of the belt 101, however, the rotating belt 101 may slide in contact with the surface of the heat roll 103 without the rotation of the heat roll 103, and heat may be transmitted to the belt 101 at that time to heat the belt 101.

The present invention may be employed for the gloss providing device and the image forming system.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. A fixing device comprising:

a fixing member that comes into contact with a recording medium while rotating;

a heating unit that heats the fixing member;

a pressing member that presses the recording medium to the fixing member while rotating; and an air supply unit that supplies air to a part of the pressing member between a contact position between the pressing member and the fixing member and 90 degrees toward a downstream side of the pressing member in a rotating direction from the contact position between the pressing member and the fixing member.

2. The fixing device according to claim 1, wherein the air supply unit has an air supply port in a wedge shaped space formed by a surface of the pressing member and a surface of a transporting path of the recording medium.

3. The fixing device according to claim 1 , wherein the air supply unit includes a first air supply port facing the pressing member and a second air supply port facing a transporting path of the recording medium, and wherein the air is supplied to the pressing member from the first air supply port and the air is supplied to the recording medium having passed the contact position between the fixing member and the pressing member from the second air supply port.

4. An image forming system comprising:

an image forming apparatus that forms images on both surfaces of a recording medium; and a fixing apparatus that is located downstream of the image forming apparatus in a process direction to fix the images on both the surfaces of the recording medium, wherein the fixing apparatus includes the fixing device according to claim 1.

5. A gloss providing device comprising:

a belt member that comes into close contact with a recording medium and transports the recording medium;

a heating member that is provided with a heat source therein and around which the belt member is entrained;

a pressing member that is arranged to face the heating member across the belt member and presses the recording medium while rotating;

a separating member around which the belt member is entrained to separate the recording medium from the belt member;

a cooling unit that is arranged between the separating member and the heating member and comes into contact with an inner peripheral surface of the belt member to cool the belt member; and an air supply unit that supplies air to a part of the pressing member between a contact position between the pressing member and the belt member and 90 degrees toward a downstream side of the pressing member in a rotating direction from the contact position between the pressing member and the belt member.

6. The gloss providing device according to claim 5, wherein the air supply unit includes an air supply port in a wedge shaped space formed by a surface of the pressing member and a surface of the belt member.

7. The gloss providing device according to claim 5, wherein the air supply unit includes a first air supply port facing the pressing member and a second air supply port facing the belt member on an upstream side of the cooling unit in the transporting direction of the recording medium, and wherein the air is supplied to the pressing member from the first air supply port and the air is supplied to the recording medium having passed the contact position between the heating member and the pressing member from the second air supply port.

8. The gloss providing device according to claim 7, wherein the air supply unit supplies the air to the pressing member and the recording medium having not yet reached an area opposed to the cooling unit.

9. The gloss providing device according to claim 7, wherein an air supply direction to the recording medium includes a component corresponding to the transporting direction of the recording medium.

10. An image forming device comprising:

an image forming apparatus that forms images on both surfaces of a recording medium; and a gloss providing apparatus that is located on a downstream side of the image forming apparatus to provide gloss to both the surfaces of the recording medium;

wherein the gloss providing apparatus includes the gloss providing device according to claim 5.

11. A fixing device comprising:

a fixing member that comes into contact with a recording medium while rotating;

a heating unit that heats the fixing member;

a pressing member that presses the recording medium to the fixing member while rotating; and an air supply unit that supplies air to a part of the pressing member between a contact position between the pressing member and the fixing member and 90 degrees toward a downstream side of the pressing member in a rotating direction from the contact position between the pressing member and the fixing member, wherein the air supply unit includes a first air supply port facing the pressing member and a second air supply port facing a transporting path of the recording medium.

* * * * *